United States Patent [19]

Keffeler

[11] Patent Number: 4,735,318

[45] Date of Patent: Apr. 5, 1988

[54] MEDICATION DISPENSER WITH REMOVABLE LINER AND FULL SKIRTED COMPARTMENT COVERS

[76] Inventor: Paul J. Keffeler, 9706 Brentwood Rd., Omaha, Nebr. 68114

[21] Appl. No.: 90,239

[22] Filed: Aug. 26, 1987

Related U.S. Application Data

[63] Continuation-in-part of Ser. No. 73,062, Jul. 13, 1987.

[51] Int. Cl.[4] ..... B65D 83/04

[52] U.S. Cl. ..... 206/532; 206/538; 206/561; 206/601; 220/410

[58] Field of Search ..... 206/538, 532, 601, 539, 206/498; 220/408, 410

[56] References Cited

U.S. PATENT DOCUMENTS

| | | | |
|---|---|---|---|
| 2,125,856 | 8/1938 | DeWitt | 220/22 |
| 2,917,162 | 12/1959 | Horland | 206/538 |
| 3,703,955 | 11/1972 | Inacker | 206/42 |
| 3,823,817 | 7/1974 | Hughes | 206/349 |
| 3,921,804 | 11/1975 | Halbich | 206/532 |
| 4,163,496 | 9/1979 | Doghotti | 206/538 |
| 4,253,572 | 3/1981 | Halbich | 206/538 |
| 4,372,445 | 2/1983 | Keffeler | 206/532 |

*Primary Examiner*—Joseph Man-Fu Moy
*Attorney, Agent, or Firm*—Zarley, McKee, Thomte Voorhees & Sease

[57] ABSTRACT

A medication dispenser includes a reusable container adapted to receive one or more disposable multicompartment liners for sanitary storage of medication out of contact with the reusable container. The open-topped compartments of the liners are closed by individual covers which are locked onto the container with a fracturable tab which must be broken to open a compartment. Each cover has a depending peripheral flange adapted for insertion into a peripheral channel around each compartment of the liner to form an air-tight seal for tamper-proof sanitary airtight storage of a patient's medication.

21 Claims, 2 Drawing Sheets

MEDICATION DISPENSER WITH REMOVABLE LINER AND FULL SKIRTED COMPARTMENT COVERS

CROSS REFERENCE TO RELATED APPLICATION

This application is a continuation-in-part of applicant's U.S. patent application Ser. No. 73,062, filed on July 13, 1987 and entitled MEDICATION DISPENSER WITH REMOVABLE LINER AND SEALED COMPARTMENTS.

BACKGROUND OF THE INVENTION

This invention relates generally to a multiple-unit medication container including several unit-dose compartments and more particularly to such a container wherein the unit-dose compartments are formed in a removable liner and sealed by separate full skirted covers.

U.S. Pharmacopeia XX defines unit-dose container as a single-unit container for articles intended for administration by other than the parenteral route as a single dose, direct from the container. A single-unit container is defined as one that is designed to hold a quantity of drug intended for administration as a single dose or a single finished device intended for use promptly after the container is opened. Accordingly, each compartment of a multiple-unit container must meet the above definitions in order to be used in compliance with current federal regulations.

Several such containers have been previously proposed such as those disclosed in Halbich, U.S. Pat. Nos. 4,253,572 and Keffeler, 4,372,445. Whereas the Halbich container has covers which are intended to provide an airtight closure for the individual compartments, the lack of any direct connection between each individual compartment cover and the container itself leaves that container susceptible to undetected displacement of the entire cover assembly for removal of medication from the compartments. The medication dispenser of the inventor's own prior U.S. Pat. No. 4,372,445 provides a direct connection between each compartment cover and the container, but, like Halbich, allows the medication to contact the reusable container.

A reusable medication container is advantageous for greatly reducing the labor required for packaging medication since patient identification and dispensing directions can be secured to the container for reuse with each refill. Undesirable features of prior reusable containers, however, include medication contamination by dust in the container and possible cross contamination by previous medication.

Another problem associated with medication containers is that air and moisture deteriorate certain medications. Pills are not placed in individual tamperproof containers for economical reasons but, with many pills stored in a single container, the removal of one pill admits air and moisture to all of the others.

Other problems and objectives for medication containers include providing truly tamperproof compartments for foolproof monitoring of the dispensed medications and limiting the quantity of pills in the container so that the patient is assured of receiving fresh medication in accordance with a prescription which is regularly reviewed by the patient's doctor at each refilling of the container. These and other problems are believed to be resolved by the medication dispenser of the invention.

A primary object of the invention therefore, is to provide an improved medication dispensing container.

Another object is to provide a medication dispensing container with a multicompartment disposable liner for sanitary storage of the medication.

Another object is to provide a multi-compartment medication dispenser wherein the closure for the individual compartments provides an air-tight seal.

Another more specific object is to provide such a dispenser wherein the air-tight seal is formed by a full skirt on each compartment cover being received within a peripheral channel surrounding each compartment.

Another object is to provide a medication dispenser having truly tamperproof unit-dose compartments.

Another object is to provide a medication dispensers with various numbers of compartments which thereby assures freshness of the medication and review of the prescription upon each refill.

Another object of the invention is to provide a medication dispenser which is economical to manufacture, durable in use and refined in appearance.

SUMMARY OF THE INVENTION

The medication dispenser of the present invention includes a unitary container defining a generally trough shaped cavity for receiving a disposable multicompartment liner so that medication placed within the liner is maintained out of direct contact with the reusable container. The covers for the individual compartments include peripheral sealing flanges for receipt within channels surrounding the liner compartments to afford an air-tight closure for each compartment.

Each compartment cover includes an integral fracturable tab adapted to be independently snap-fit onto the container to provide a secure and tamperproof closure of each compartment. Several covers are interconnected by fracturable links to form the unitary cover assembly which may be easily handled and snapped onto the container for quickly and easily closing all of the compartments. Likewise, the provision of a single multicompartment liner greatly facilitates the replacement of the liners each time the container is to be refilled.

Medication stored within the container contacts only the disposable liner and disposable covers thereby assuring sanitary storage and preventing contamination of the medication with any previous medications or other foreign matter. The air-tight seal of each compartment assures the patient of fresh medication protected from deterioration associated with repeated exposure to air and moisture.

DESCRIPTION OF THE PREFERRED EMBODIMENT

Figure 1:
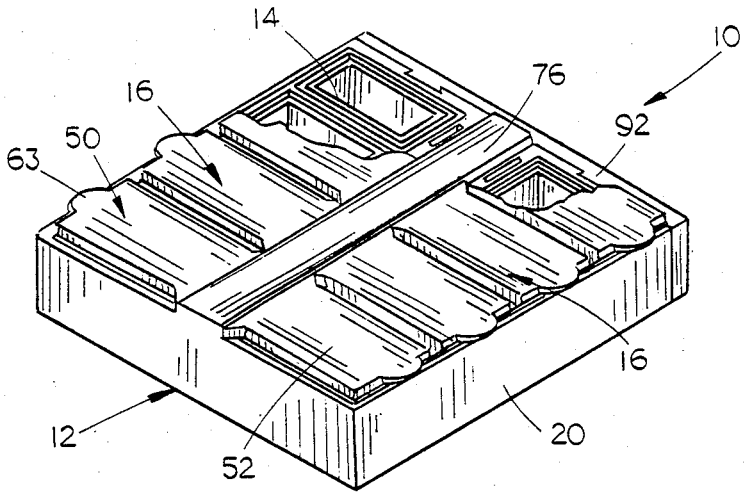
FIG. 1 is a perspective view of the medication dispenser with portions broken away for clarity.
Figure 2:
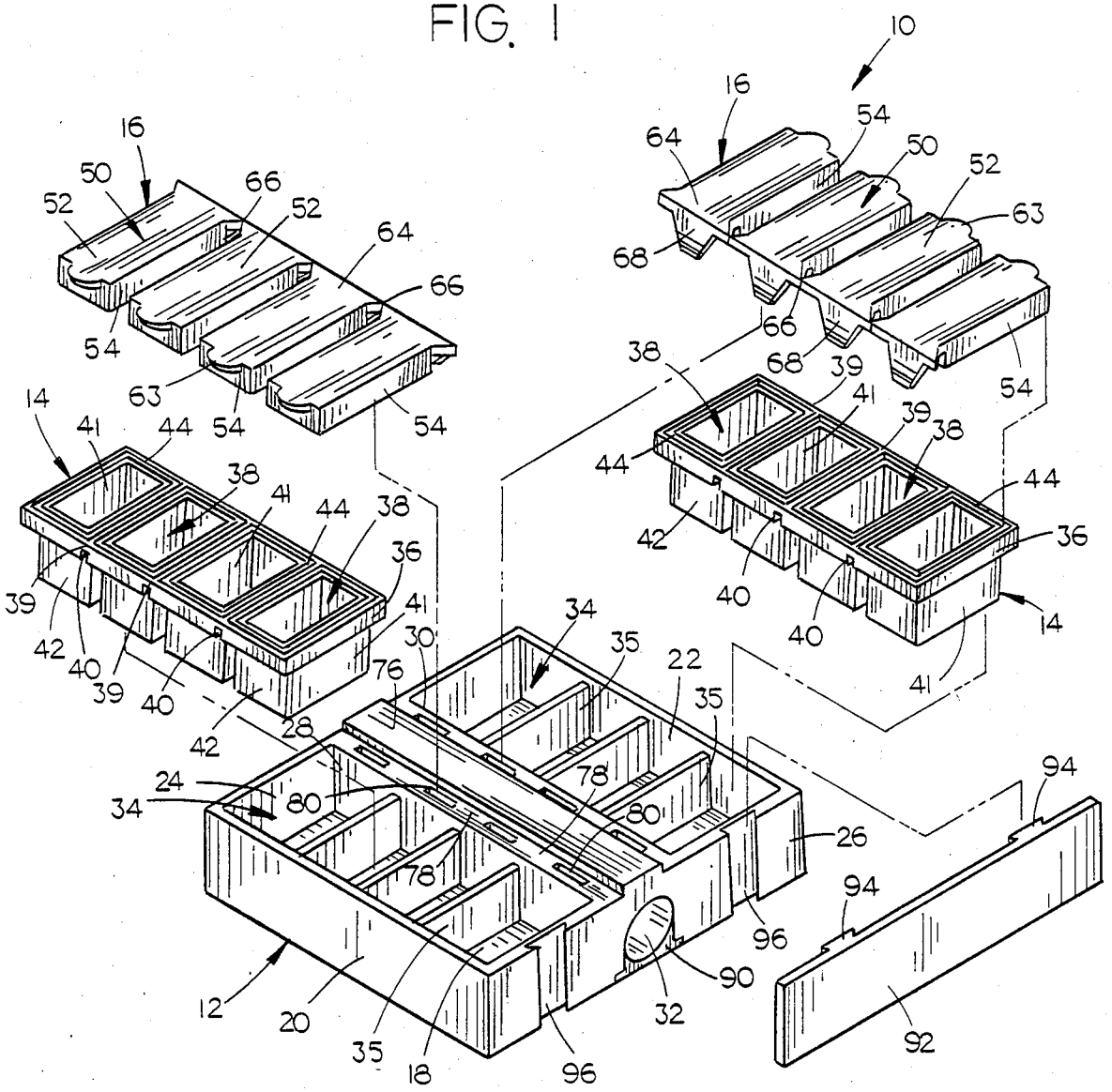
FIG. 2 is an exploded perspective view of the medication dispenser of the invention.

The medication dispenser 10 of the present invention is illustrated in FIGS. 1 and 2 as including a container 12, a pair of removable multicompartment liners 14 and a pair of compartment cover assemblies 16.

Container 12 includes a bottom wall 18, opposite upstanding side walls 20 and 22, opposite upstanding end walls 24 and 26 and at least one divider wall 28 extended between the end walls in spaced relation from side wall 20. A second divider wall 30 is positioned in spaced relation from the other side wall 22 and from divider wall 28 so as to form an elongated channel or chamber 32 (FIGS. 2 and 3) between the divider walls.

Likewise, an elongated generally trough shaped cavity 34 is arranged between each divider wall and the adjacent container side wall.

Figure 3:
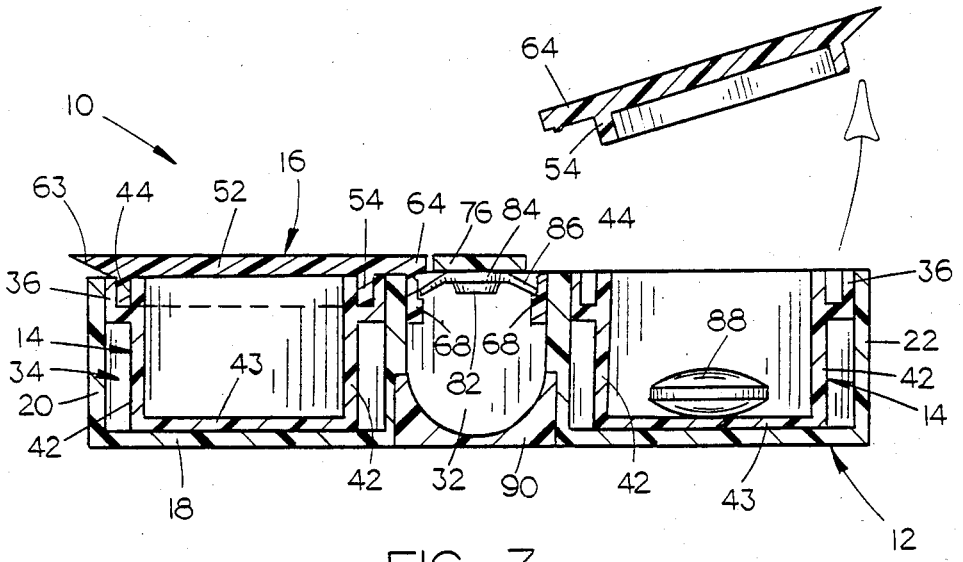
FIG. 3 is an enlarged transverse sectional view.

The removable liner 14 is illustrated in FIGS. 2 and 3 as insertable into a container cavity 34. At least the upper periphery 36 of each liner 14 is of a size and shape to fit within and substantially fill an upper portion of cavity 34. Liner 14 may be described as a plurality of separate compartments 38 arranged in aligned but spaced apart relation and connected together by integral links 39. Each compartment includes a pair of sidewalls 41, opposite end walls 42 and a bottom wall 43, all connected together at their adjacent edges. An open topped peripheral channel 44 surrounds each compartment 38 for a sealed engagement with the compartment covers as described below. Finally, a bottom channel 46 is formed in the underside of each connecting link 39 for receiving an upper edge of a container partition 35 to securely seat the liner 14 in the cavity 34.

FIG. 2 shows a unitary cover assembly 16 which includes a sufficient number of individual compartment covers 50 for closing all of the compartments 38 of one liner 14. Each cover 50 is adapted to overlie and close the respective one of the liner compartments 38 upon insertion of the liner 14 into the container cavity 34.

Referring to FIGS. 2 and 4–7, each cover 50 includes a top wall 52 and a depending peripheral skirt or flange 54 which is of a size, shape and position for receipt within the peripheral channel 44 of a liner compartment 38 to form an airtight seal therewith. A semicircular extension 63 at the outer edge of each top wall 52 facilitates lifting the cover 50 to open a compartment 38. At the inner end of top wall 52, an integral portion 64 extends generally horizontally inwardly away from depending flange 54 and flares outwardly to form fracturable links 66 for interconnecting a plurality of covers so that they may be handled as an integral assembly 16.

An important feature of each compartment cover 50 is the locking tab 68 which functions to independently secure each compartment cover 50 to container 12. Each tab is a generally flat downwardly tapering member arranged parallel to flange 54. The spacing between tab 68 and flange 54 is just sufficient for receiving a container divider wall 28 and liner compartment end wall 42 between them as illustrated in FIG. 3. Each tab 68 is further provided with an upwardly facing shoulder 70 on the interior side thereof and a weakened upper portion 72 formed by a notch 74 adjacent the juncture of the tab to portion 64.

Before describing the connection of each cover 50 to the container 12, a description of the remaining structure of the container would be helpful. In FIGS. 2 and 3, a top wall 76 extends between and is connected to the upper edges of both divider walls 28 and 30. In the embodiment shown, each divider wall includes a plurality of interiorly directed and spaced apart projections 78 along its upper edge for supporting the elongated top wall 76. The top wall 76 cooperates with the divider walls 28 and 30 to define a plurality of elongated spaced apart openings 80 for receiving the tabs 68 of the compartment covers 50.

Figure 4:
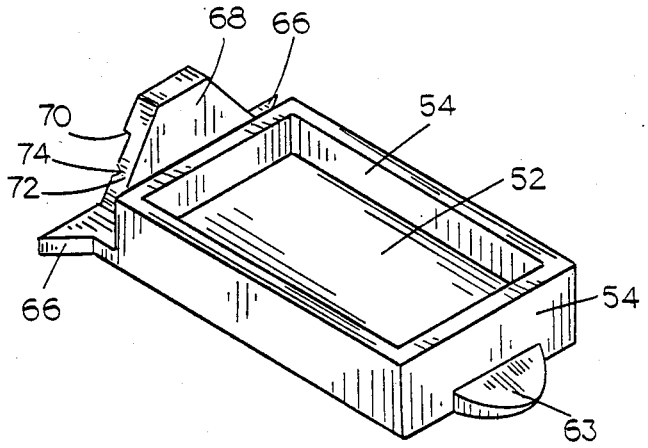
FIG. 4 is an enlarged perspective view of an inverted compartment cover.

In FIG. 4, the underside of top wall 76 is shown as including a plurality of fasteners 82 in longitudinally spaced apart relation for supporting a spring strip 84 which includes a plurality of spaced apart downwardly and exteriorly inclined pawls 86. A similar structure for fracturable connection of covers onto a medication dispenser is shown and described in the inventor's U.S. Pat. No. 4,372,445 which is incorporated herein by reference.

Referring to FIG. 3, when a compartment cover 50 is applied onto the container 12, the tab 68 deflects the pawl 86 downwardly to allow passage of the tab through the slot defined between the pawl 86 and divider wall 28. As the cover reaches its seated position with portion 66 in engagement with the divider wall 28, the upwardly facing shoulder 70 on tab 68 is moved downwardly of pawl 86 allowing it to snap back against the tab above the shoulder so as to function somewhat like a rachet to prevent vertical upward removal of the tab through the opening 80.

Note that the liners 14 are inserted into the container cavities 34 prior to attachment of the cover assemblies 16. Accordingly, at the same time that the covers 50 are seated on the container 12, the depending peripheral flanges 54 are pressed into the peripheral channels 44 of the liner in snug-fit relation so as to close and seal each of the open-topped compartments. The outwardly protruding semicircular extension 63 on the outer end of each cover 50 engages the outer sidewall 20 of the liner as shown in FIG. 3 to positively seat the cover onto and within the liner compartment 38.

When a compartment is to be opened, the outer end of cover 50 is pivoted upwardly which results in the fracture of the tab 68 at weakened portion 72 as indicated in FIG. 3. Similarly, the fracturable links 66 connecting that cover to adjacent covers are similarly fractured. In FIG. 3, it is seen that the fractured tab 68 is held in place by the pawl 86. After all of the covers have been opened and fractured from the container, the liners 14 can be lifted freely from the container cavities 34. The liners will generally be disposed of and replaced with new liners to provide a sanitary environment for storing the next refill of medication such as the pill 88 shown in FIG. 4. A new cover 50 is then applied onto the refilled compartment to provide an air-tight closure. The tab 68 of the new cover will dislodge the former tab 68 from the pawl 86 and push it downwardly into the chamber 32 between divider walls 28 and 30. For this purpose, a generally U-shaped channel section 90 is secured between divider walls 28 and 30 to close the bottom of chamber 32 for collecting the disgarded tabs.

In FIGS. 1 and 2, it is seen that the end of chamber 32 is closed by a closure plate 92 provided with flaring tenons 94 adapted for receipt within the mortises 96 in the container end wall 26 for a dovetail connection between them. It is apparent that any other suitable closure could be substituted which affords access to chamber 32 for removing the fractured tabs 68.

Whereas the medication dispenser 10 has been illustrated in an embodiment including two liners of four compartments each, it is understood that other medication dispensers may provide for the insertion of only a single liner or liners with more or less than four compartments. Likewise, the associated cover assemblies 16 would be provided with the same number of individual covers 50. The illustrated medication compartment is often preferred since it will accommodate one week's medication for a patient plus one spare compartment which may be covered with an opaque cover 50, if preferred.

Suitable marking such as days of the week or numerals may be applied on the top wall strip 76, for example, to facilitate the orderly identification of compartments and the sequence in which the medication is to be administered.

In operation, for example, a pharmacist may place in a lined container 12 all of the prescriptions required by a given patient for a period of one week and then quickly and easily press the cover assemblies onto the container to secure the liners therein and to close and seal the individual liner compartments. Note that several prescriptions may be placed in several separate containers or all prescriptions may be placed in a single container, according to the discretion of the pharmacist. The filled dispenser 10 is then delivered to the nurses or authorized aides at a nursing home or hospital or for home health care. The manual labor required for refilling the dispenser is substantially reduced since the patient identification and medication information can be permanently secured to the container 12 and reused for each refill. Whereas the containers are readily reusable, the medication is stored in a sanitary condition since it contacts only the disposable liners and covers. The air-tight closure of each compartment preserves the medication from deterioration associated with exposure to air and moisture.

Thus there has been shown and described a medication dispenser which accomplishes at least all of the stated objects.

I claim:

1. A medication dispenser, comprising a container comprising at least one upstanding sidewall, opposite upstanding end walls, and a divider wall extended between said end walls in spaced relation from said one side wall to define a generally trough shaped cavity, a multicompartment liner removably insertable into said cavity, said liner defining a plurality of open-topped compartments and a plurality of peripheral channels, each surrounding a respective compartment, whereby medication placed within said compartments is maintained out of direct contact with said container, a plurality of disposable compartment covers, each adapted to overlie and close a respective one of said compartments upon insertion of said liner into said container cavity, each cover including a separate integral fracturable tab and adjacent to one end thereof, coacting lock means on said container and on the individual tabs for independently securing each tab in snap-fit locked relation onto said container, each cover being fractured from its respective tab in response to upward movement of the opposite end of said cover to open said compartment, and each cover further including a top wall and a peripheral flange depending from said top wall and being of a size, shape, and position for receipt within a respective peripheral channel of said liner to provide a substantially air tight closure of the respective compartment upon securement of said covers in snap-fit locked relation onto said container and liner.

2. The medication dispenser of claim 1 wherein said liner is generally rectangular and defines a plurality of generally rectangular compartments.

3. The medication dispenser of claim 1 wherein said tab depends from the cover top wall in spaced relation from said flange for receiving said divider wall and a portion of a liner therebetween.

4. The medication dispenser of claim 1 wherein said container is made of a plastic material and said liner is made of a softer plastic material.

5. The medication dispenser of claim 1 wherein said container further comprises a plurality of partitions extended between said divider wall and the one side wall.

6. The medication dispenser of claim 5 wherein said partitions engage said bottom wall and extend upwardly therefrom.

7. The medication dispenser of claim 5 wherein said compartments of each liner are arranged in spaced apart relation for receiving said container partitions therebetween.

8. The medication dispenser of claim 7 wherein each compartment of said liner is connected to an adjacent compartment by an integral link, each link including a channel in the underside thereof for receiving a container partition upon placement of the liner into the container cavity.

9. The medication dispenser of claim 8 wherein each liner compartment includes opposite side walls, end walls and bottom wall.

10. The medication dispenser of claim 1 wherein said container further comprises a bottom wall.

11. A multicompartment liner and cover assembly for a medication dispenser container including at least one upstanding side wall, opposite upstanding end walls and a divider wall tended between said end walls in spaced relation from one side wall to define a generally trough shaped cavity, and a plurality of cover lock means on said container adjacent said divider wall, said compartment liner and cover assembly comprising, a multicompartment liner removably insertable into said cavity, said liner defining a plurality of open-topped compartments and a plurality and a plurality of peripheral channels, each surrounding a respective compartment, whereby medication placed within said compartment is maintained out of direct contact with said container, a plurality of disposable compartment covers, each adapted to overlie and close a respective one of said compartments upon insertion of said liner into said container cavity, each cover including a separate integral fracturable tab adjacent one end thereof for independent securement to said container, coacting lock means on each tab adapted for cooperation with a respective tab in snap-fit relation onto said container, each tab being fractured from its respective cover in response to upward movement of the opposite end of said cover to open said compartment, and each cover further including a top wall and a peripheral flange depending from said top wall and being of a size, shape and position for receipt within a respective peripheral channel of said liner to provide a substantially air-tight closure of the respective compartments upon securement of said covers in snap-fit locked relation onto said container and liner.

12. The medication dispenser of claim 11 wherein said liner is generally rectangular and defines a plurality of generally rectangular compartments.

13. The medication dispenser of claim 11 wherein said tab depends from the cover top wall in spaced relation from said flange for receiving said divider wall and a portion of a liner therebetween.

14. The medication dispenser of claim 11 wherein said container is made of a plastic material and said liner is made of a softer plastic material.

15. The medication dispenser of claim 11 wherein said container further comprises a plurality of partitions extended between said divider wall and the one side wall.

16. The medication dispenser of claim 15 wherein said partitions engage said bottom wall and extend upwardly therefrom.

17. The medication dispenser of claim 15 wherein said compartments of each liner are arranged in spaced apart relation for receiving said container partitions therebetween.

18. The medication dispenser of claim 17 wherein each compartment of said liner is connected to an adjacent compartment by an integral link, each link including a channel in the underside thereof for receiving a container partition upon placement of the liner into the container cavity.

19. The medication dispenser of claim 9 wherein each liner compartment includes opposite side walls, end walls and bottom wall.

20. A multicompartment liner for a medication dispenser container assembly including a container having at least one upstanding side wall, opposite upstanding end walls and a divider wall extended between said end walls in spaced relation from one side wall to define a generally trough shaped cavity, and a plurality of cover lock means on said container adjacent said divider wall and a plurality of disposable compartment covers, each cover including a separate integral fracturable tab adjacent one end thereof for independent securement to said container, coacting lock means on each tab adapted for cooperation with a respective cover lock means for securing said cover in snap-fit relation onto said container, each tab being fractured from its respective cover in response to upward movement of the opposite end of said cover to open said compartment, and a top wall and a peripheral flange depending from said top wall, said compartment liner comprising, a multicompartment liner removably insertable into said cavity said liner defining a plurality of open-topped compartments whereby medication placed within said compartments is maintained out of direct contact with said container, said liner further defining a plurality of peripheral channels, each surrounding a respective compartment and being of a size, shape and position for receiving a depending peripheral flange of a respective cover in sealing engagement therein upon securement of said covers in snap-fit locked relation onto said container with a liner inserted therein, thereby to provide a substantially air-tight closure of said compartments.

21. A multicompartment cover assembly for a medication dispenser container assembly including a container having at least one upstanding side wall, opposite upstanding end walls and a divider wall extended between said end walls in spaced relation from one side wall to define a generally trough shaped cavity, and a plurality of cover lock means on said container adjacent said divider wall, and a multicompartment liner removably insertable into said cavity, said liner defining a plurality of open-topped compartments whereby medication placed within said compartments is maintained out of direct contact with said container, said liner further defining a plurality of peripheral channels, each surrounding a respective compartment, said cover assembly comprising, a plurality of disposable compartment covers, each adapted to overlie and close a respective one of said compartments upon insertion of said liner into said container cavity, each cover including a separate integral fracturable tab adjacent one end thereof for independent securement to said container, coacting lock means on each tab adapted for cooperation with a respective cover lock means to secure the respective tab in snap-fit relation onto said container, each tab being fractured from its respective cover in response to upward movement of the opposite end of said cover to open said compartment, and each cover further including a top wall and a peripheral flange depending from said top wall and being of a size, shape and position for receipt within a respective peripheral channel in sealing engagement therewith upon securement of said covers in snap-fit locked relation onto said container with a liner inserted therein thereby to provide a substantially air-tight closure of said compartments.

* * * * *